United States Patent [19]

Mason et al.

[11] 4,216,950

[45] Aug. 12, 1980

[54] STEADY REST

[76] Inventors: W. Alfred Mason, P.O. Box 988, Big Bear Lake, Calif. 92315; Kenneth L. Gerry, 232 N. Sherman Unit F., Corona, Calif. 91720

[21] Appl. No.: 13,023

[22] Filed: Feb. 21, 1979

[51] Int. Cl.[2] ..... B25B 1/24

[52] U.S. Cl. ..... 269/271; 269/296; 269/307

[58] Field of Search ..... 51/217 R, 238 R, 238 S, 51/239; 269/60, 71, 73, 140, 152, 155, 240, 244, 257, 258, 259, 262, 265, 271, 282, 296, 307

[56] References Cited

U.S. PATENT DOCUMENTS

| | | | |
|---|---|---|---|
| 1,318,688 | 10/1919 | Paschall | 269/60 |
| 2,882,656 | 4/1959 | Novkov | 51/217 R |
| 3,341,190 | 9/1967 | Adamson | 269/271 |

*Primary Examiner*—Robert C. Watson

*Attorney, Agent, or Firm*—Georges A. Maxwell

[57] ABSTRACT

A machine vise having a first jaw with a flat, inwardly disposed inner face, a second jaw with a flat, inwardly disposed inner face opposing the inner face of the first jaw, a jaw plate carried by each jaw and including a block-like body with a flat face in bearing engagement with the inner face of the jaw and a flat, inwardly disposed work-engaging surface, fastener means securing the body on the jaw, one or both of said jaws includes a vertically adjustable steady rest comprising an elongate work-engaging bar adjacent to and extending laterally of said work-engaging surface, an elongate vertical guideway in the body and opening at the work-engaging surface, a guide block fixed to the bar and slidably engaged in said guideway and an elongate vertical jack screw carried by the body for free rotation and against axial movement and extending longitudinally through said guideway and threadedly engaged through said block.

10 Claims, 7 Drawing Figures

STEADY REST

This invention has to do with machine vises and is particularly concerned with a novel machine having jaw plates with adjustable steady rest bars.

BACKGROUND OF THE INVENTION

The ordinary or common form of machine vise provided to hold and support pieces of work in predetermined position in a related machine tool, preparatory to and while being worked upon, includes an elongate longitudinal bed with front and rear ends and longitudinally extending rails, a fixed or stationary jaw with a flat vertical face disposed longitudinally rearwardly projecting upwardly from one end of the bed, an upwardly projecting movable jaw with a flat vertical longitudinally forwardly disposed face rearward of the fixed jaw and having guideways slidably engaged with the rails of the bed; and manually operable screw means carried by the bed, rearward of the movable jaw and engaging said movable jaw to move that jaw longitudinally toward and away from the fixed jaw, as desired, or as circumstances require.

Further, in practice, the ordinary or conventional machine vise of the character referred to above is provided with removable and/or replaceable jaw plates, which plates are arranged in flat bearing engagement on the noted faces of the vise jaws and are releasably secured thereto by screw fastener means.

Machine vises of the character or class referred to above are widely used throughout the art of machining and are well known to those who are familiar with the art to which the present invention relates.

In the course of using vises of the character referred to above, the beds of the vises are suitably arranged and supported on the work tables or the like of related machine tools and the pieces of work to be worked upon by the cutting means of the machine tools are manually arranged in desired predetermined relationship relative to the stationary jaw and the movable jaw is thereafter advanced towards and into engagement with the piece of work, by manually operating the screw means of the vise.

The above procedure of arranging and clamping a piece of work in a vise must, as a general rule, be carried out with great care and skill since the piece of work must be supported by the vise in precise predetermined position within the working area of its related machine tool, before it is worked upon. As a result of the foregoing, the noted procedure is time consuming and therefore extremely costly.

In practice, where a plurality of like places of work are to be worked upon in and by a machine tool, the machine vise is mounted on the work table of the machine tool with its stationary jaw in fixed predetermined position relative thereto and so that when the work pieces are arranged between the jaws, the machinist only needs to manually adjust the positioning of the work pieces laterally and vertically relative to the fixed jaw, preparatory to advancing the movable jaw into clamped engagement with it. This modified procedure often materially reduces set-up time, that is the time required to effect positioning and clamping of a piece of work within the vise and relative to a related machine tool.

When a large number of like pieces of work are to be worked upon and to further reduce the set-up time, skilled machinists frequently make and arrange "steady rest" blocks and the like on the beds of the vises, between the jaws thereof, to stop and support the pieces of work in predetermined vertical position between the vise jaws, whereby they need only concern themselves with lateral positioning of the work pieces, when setting up the work.

While the last noted modified procedure and use of separate steady rest means is effective to further reduce set-up time, it is only practiced when the number of pieces of work to be worked upon is sufficient to justify the time and expense that is required to make a suitable steady rest structure and/or means.

As a general rule, when the number of pieces of work is sufficient to justify the making of special steady rest means for use within machine vises, the time and expense in producing full production tooling is generally warranted and the use of a conventional machine vise is dispensed with.

Prior to the present invention, the prior art has failed to provide procedures and/or means which are both economically feasible and practical to simplify and speed the time required to set up a few or limited number of pieces of work in a machine vise.

OBJECTS AND FEATURES OF THE INVENTION

It is an object and feature of my invention to provide means to effectively and efficiently reduce the set-up time to arrange a limited number of like (or dissimilar) pieces of work in predetermined clamped relationship within and between the jaws of a machine vise.

Another object and feature of my invention is to provide means of a general character referred to above which include work engaging steady rest bars adjacent the work engaging faces of vise jaw plates and manually operable screw means carried by said plates and engaging the bars to vary and/or adjust the vertical position of the bars relative to the plates, whereby the steady rest bars can be easily and quickly adjusted to effectively stop and assure predetermined vertical positioning of a single or multiplicity of like work pieces sequentially arranged within and held by the vise.

It is another object and feature of my invention to provide means of the character referred to above wherein the jaw plates and steady rest bars have related cooperating calibrations to accurately indicate the vertical positions of the bars relative to their related jaws whereby the relative vertical positioning of the bars can be effectively ascertained and adjusted as circumstances may require and so that the steady rest bars can, from time to time, be adjusted and set in predetermined vertical positions for different pieces of work, as and when they are to be worked upon.

It is also an object and feature of my invention to provide a vise of the general character referred to having one or more adjustable steady rest bars having work engaging surfaces to support and insure constant accurate positioning of work while it is under the pressure of cutters and machine tool head.

Finally, it is an object and feature of my invention to provide a structure of the general character referred to above which is rugged and durable, highly effective and dependable in operation and which is both easy and economical to make and use.

The foregoing objects and features of my invention will be fully understood from the following detailed description of the invention, throughout which description reference is made to the accompanying drawings.

DETAILED DESCRIPTION OF THE INVENTION

Figure 1:
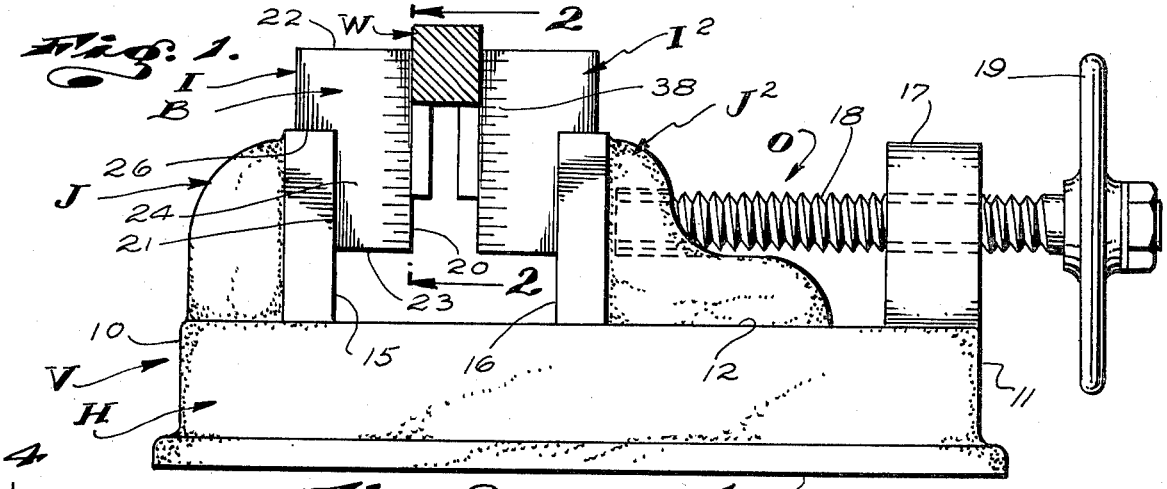
FIG. 1 is a side elevational view of a machine vise with which my invention is related.
Figure 2:
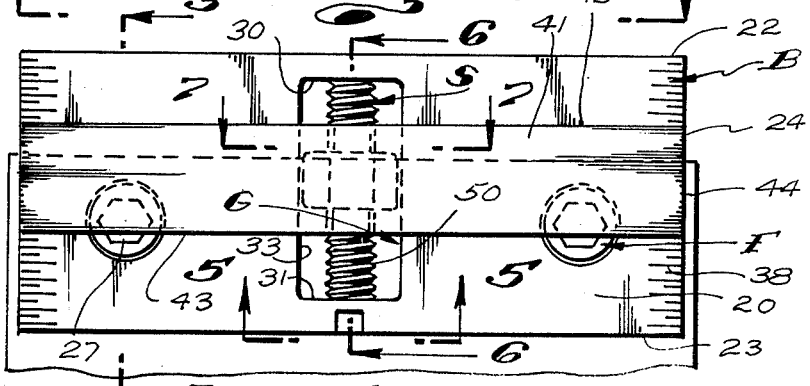
FIG. 2 is a view taken as indicated by line 2—2 on FIG. 1.

In FIG. 1 of the drawings, I have illustrated a typical or conventional machine vise V with novel jaw plates I embodying my invention related to it.

The vise V shown in the drawings is intended to illustrate the basic characteristics of common machine vises with which my novel vise jaw plates can be advantageously related. The vise V includes an elongate horizontal bed H having front and rear ends 10 and 11, a flat top 12 and a flat machine tool table engaging bottom 14. Projecting upwardly from the front portion of the bed H is a stationary or fixed front jaw J. The jaw J has a flat, vertical, transversely extending rearwardly or longitudinally inwardly disposed face 15 adapted to normally engage a piece of work W related to the vise. Projecting upwardly from the rear portion of the bed H and shiftable longitudinally relative thereto is a movable jaw $J^2$. The jaw $J^2$ has a flat, vertical, transversely extending forwardly or longitudinally inwardly disposed face 16 which is in spaced opposing relationship with the face 15 on the jaw J and which is adapted to normally engage the work piece W related to the vise and positioned adjacent the face 15.

The movable jaw $J^2$ is retained on the bed and is maintained in alignment relative thereto by appropriate guide means, such as laterally spaced, parallel, longitudinally extending rails (not shown) in the top of the bed and guideways (not shown) in the lower portion of the jaw $J^2$ and cooperatively engaged with the rails.

In practice, the jaws of machine vises of the class here concerned with are frequently two-part structured and include load supporting body parts and jaw plates screw fastened to flat, machined, plate seating surfaces on the body parts. The plates, which define the work engaging faces of the vise jaws are such that they can be removed and replaced by new plates or by special plates, as desired, or as circumstances require.

Finally, the vise V includes manually operable screw means O to move the rear movable jaw longitudinally of the bed and to urge that jaw into desired pressure engagement with the work piece W engaged with and stopped by the jaw J. The means O can vary widely in practice and in the case illustrated includes an upwardly projecting bearing block 17 at the rear end of the bed H, an elongate longitudinally extending screw 18 with front and rear ends, extending through and supported by the block for free rotation and against axial movement, and a manually engageable operating crank or wheel 19 secured to the rear end of the screw. The front end of the screw establishes driving engagement with the rear end of the movable jaw $J^2$. As illustrated in dotted lines in FIG. 1 of the drawings, the front end of the screw 18 is engaged and is suitably retained in a rearwardly opening socket in the jaw $J^2$.

The novel jaw plates that I provide are adapted to be releasably secured to the standard jaw plates of a related machine vise or can, if desired, replace and be used instead of the standard jaw plates on their related vise.

In the preferred carrying out and use of the present invention, two like jaw plates are provided, there being a front plate I related to the front fixed jaw J and a rear plate $I^2$ related to the rear movable jaw $J^2$, as clearly shown in FIG. 1 of the drawings.

Referring to FIGS. 2 through 7 of the drawings, the jaw plate I includes an elongate, laterally extending block-like body B with a flat, vertical longitudinally rearwardly disposed work engaging surface 20, a flat, vertical front surface 21, flat, horizontal top and bottom surfaces 22 and 23, and flat vertical sides or ends 24.

Figure 3:
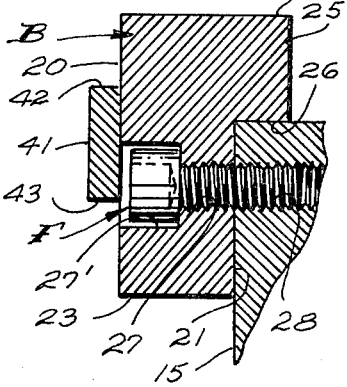
FIG. 3 is a sectional view taken as indicated by line 3—3 on FIG. 2.
Figure 4:
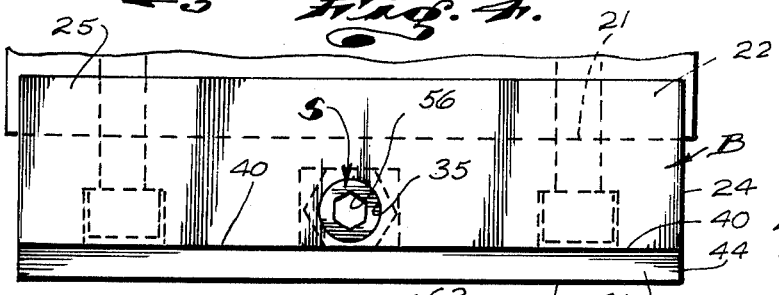
FIG. 4 is a view taken as indicated by line 4—4 on FIG. 2.
Figure 5:
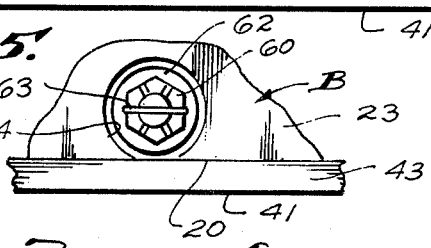
FIG. 5 is a view taken as indicated by line 5—5 on FIG. 2.

In practice, and as shown in the drawings, the body B has a forwardly projecting enlargement 25 extending transverse its upper portion and defining a downwardly disposed orienting shoulder 26. The body B is adapted to be arranged adjacent the rear of the jaw J with its front surface 21 in flat bearing engagement with the face 15 of the jaw J and with the orienting shoulder 24 in stopped engagement with the upper forward edge of the jaw or standard jaw plate, as shown in FIGS. 1 and 3 of the drawings.

It will be apparent and it is to be understood that in practice, the enlargement 25 and shoulder 26 can be eliminated without departing from or adversely affecting the broader aspects of my invention.

The body B is provided with a plurality (two or more) of forwardly and rearwardly opening through openings 27 spaced vertically and laterally therein to register with rearwardly or longitudinally inwardly opening threaded fastener receiver openings 28 entering the face 15 of the jaw J and in which screw fasteners F are engaged to releasably secure the body B with the jaw J.

In the preferred carrying out of the invention, the fasteners F are socket head cap screws and the openings 27 are provided with counter base sinks 27' to accommodate the heads of the screws, as clearly shown in the drawings.

In addition to the foregoing, the body B is provided with an elongate vertically extending, forwardly or longitudinally inwardly opening guideway G intermediate the ends of the body. The guideways G have horizontal top and bottom ends 30 and 31 spaced from the top and bottom surfaces 22 and 23 of the body, a flat, vertical inwardly disposed bottom surface 32 and flat, vertical laterally spaced opposing side surfaces 33.

The body B next includes a downwardly opening socket 34 entering its bottom surface 23, in axial alignment with the central vertical axis of the guideway G.

The body B includes upper and lower bearing openings 35 and 36 at the upper and lower ends of and in axial alignment with the central vertical axis of the guideway G.

Figure 6:
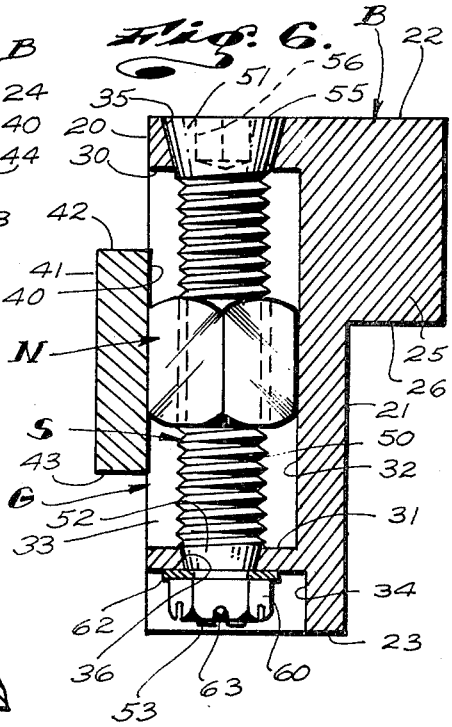
FIG. 6 is an enlarged detailed sectional view taken substantially as indicated by line 6—6 on FIG. 2.
Figure 7:
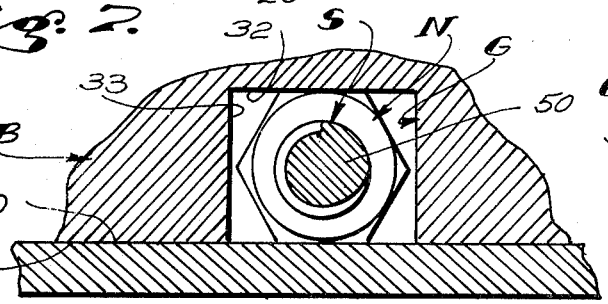
FIG. 7 is an enlarged detailed sectional view taken substantially as indicated by line 7—7 on FIG. 2.

The upper bearing opening 35 is a through opening extending between the top or upper end 30 of the guideway G and the top surface 22 of the body and the lower bearing opening 36 is a through opening extending between the bottom or lower end 31 of the guideway and the upper end or bottom of the socket 34 at the bottom 23 of the body, as clearly illustrated in FIG. 6 of the drawings.

In practice, the bearing openings are downwardly convergent tapered openings. Further, the lower opening 36 is smaller than the upper opening 35 to facilitate manufacture or establish the openings by means of a single tool on a single pass and to allow for convenient and effective assembling of the finished structure as will be apparent from a study of the drawings.

In practice, and in the preferred carrying out of my invention, the opposite vertical edge portions of the surface 20 of the body and/or the rear vertical edge portions of the ends 24 of the body are provided with vertical rows of calibrating marks 38.

It will be apparent from the foregoing that the body B is a rather simple unitary part which can be easily and conveniently produced using standard machining, casting and/or forging techniques and the like.

The jaw plate I that I provide next includes an elongate horizontal steady rest bar R of limited vertical extent, arranged in sliding bearing engagement with the rear surface 20 of the body B and extending from one side or end of the body to the other. The bar R is a simple straight bar, rectangular in cross-section and has a flat, vertical front surface 40, a flat, vertical longitudinally inwardly disposed rear surface 41, flat, horizontal top and bottom surfaces 42 and 43, and flat, vertical ends 44.

The bar R has fixed to it and is carried by a guide block N. The block N is slidably engaged in the guideway G in the body B. The block N has a vertical threaded opening, the axis of which is concentric with the bearing openings 35 and 36 in the body and in and through which a jack screw S, to be later described, is engaged.

In the case illustrated, the block N is a hexagonal nut, one facet or side of which is fixed to the front surface 40 of the bar R as by silver solder and the opposite facet or side of which occurs in free sliding engagement with the inner surface 32 of the guidway.

In practice, a special square block or nut which establishes free sliding engagement with the side surfaces as well as the inner surface of the guideway G can be provided and used instead of the hexagonal nut, if desired, or if circumstances require.

The aforementioned jack screw S includes an elongate threaded shank 50 extending longitudinally through the guideway G and in threaded engagement in and through the block N; and an enlarged downwardly convergent tapered head 51 cooperatively seated in and rotatable relative to the upper bearing opening 35 in the body, a lower downwardly tapered bearing 52 extending or continuing downwardly from the lower end of the shank and seated in and rotatable relative to the lower bearing opening 36 in the body and a depending threaded stem 53 of reduced diameter depending from the bearing 52 and freely into the socket 34 in the body.

The head 51 has a flat top 55 which is substantially flush with the top surface 22 of the body B and has an upwardly opening, central polygonal (hexagonal) turning tool receiving socket opening 56.

A retaining nut 60 is arranged wholly within the socket 34 in the body B and is threaded on the stem 53 of the screw S. The nut 60 is such that it can be advanced upwardly relative to the stem and the screw S to react on the bottom of the socket 53 to draw the screw S downwardly relative to the body whereby the head 51 and bearing 52 are urged into seated engagement in their related bearing openings 35 and 36. The screw S is thus set so that it is free from vertical movement relative to the body and so that sufficient frictional drag is afforded between the screw and the body to prevent the screw from rotating relative to the body during normal anticipated use of the construction.

In practice, a thrust washer 62 is provided about the stem 53 of the screw S, between the nut 60 and the opposing bottom of the socket 34.

In the preferred carrying out of the invention and in accordance with common practice, the nut 60 is a slotted nut and is releasably held in fixed rotative position on the stem of the screw S by means of a set pin 36 engaged in and through a slot provided in the stem and registering slots in the nut.

With the jaw plate I described above, it will be apparent that the steady rest bar can be moved vertically relative to and across the rearwardly disposed face 20 of the body B by engaging an Allen wrench or other suitable turning tool in the socket opening 56 in the top of the screw S and rotating that screw. By following such procedure, the bar can be moved and securely set in any desired position relative to the body within the wide range of movement afforded by the construction.

The upper and lower horizontal end corner edges of the bar and/or the end portions of the rear longitudinal corner edges of the bar cooperate with the calibrations 38 on the body to accurately indicate the vertical positioning of the bar relative to the body. By suitably noting the position of the bar indicated by the calibrations, it is possible to accurately set the bar in any desired predetermined vertical position.

In practice, while it is generally preferred that both the front and the rear jaw plates I and $I^2$ on the jaws J and $J^2$ of the related vise V be alike and that each include the steady rest means noted above, it is possible and in some circumstances it may be preferred that the steady rest means be eliminated or be removed from one of the plates.

In use, when the vise V with the novel jaw plates I and $I^2$ related to it is to be used to sequentially engage and hold a series of like work pieces, the first work piece can be arranged and suitably gripped by and between the opposing faces of the jaw plate in desired lateral and vertical position. Thereafter, the steady rest bars are moved up and into stopped engagement with the piece of work and the work to be performed thereon is completed. After the first piece of work has been worked upon and is released by and removed from the vise, each successive piece of work related to the vise may be first freely arranged between the jaw plates and in vertical stopped relationship with the steady rest bars. Thereafter, the machinist need only manually adjust and/or position the work laterally in the vise before operating the vise to grip the work piece.

The structure that I provide is particularly effective and economical to use when a limited number of like pieces of work are to be worked upon and the number of pieces is so limited as not to justify the time and expense that would be incurred to provide special production of tooling to hold the pieces of work.

It is to be particularly noted that the axially spaced tapered bearing openings 35 and 36 are operated with the tapered head 51 and bearing 52 of the screw S to afford zero lost motion between the screw and the body. The capability of the construction to establish zero lost motion, as noted above, is that which makes it sufficiently accurate to be of general utility in most of those circumstances in which it is to be used.

Having described only one typical preferred form and application of my invention, I do not wish to be limited to the specific details herein set forth, but wish to reserve to myself any modification and/or variations that may appear to those skilled in the art and which fall within the scope of the following claims:

We claim:

1. A machine vise including an elongate, horizontal bed with opposite sides and ends, a first jaw projecting upwardly from one end portion of the bed and having a flat, vertical, laterally extending longitudinally inwardly disposed inner face, a second jaw projecting upwardly from the other end of the bed and having a flat, vertical, laterally extending longitudinally inwardly disposed inner face opposing the inner face of the first jaw, operating means between the bed and one jaw to move that jaw longitudinally of the bed and relative to the other jaw, a jaw plate carried by each jaw and including a block-like body with a flat, longitudinally outwardly disposed outer face in bearing engagement with the inner face of the jaw and a flat, vertical, laterally extending longitudinally inwardly disposed work-engaging surface, screw fastener means carried by the body and engaged with the jaw and releasably securing the body on the jaw, one or both of said jaws includes vertically adjustable steady rest means comprising an elongate work engaging bar adjacent to and extending laterally of said work engaging surface, an elongate verticle guideway in the body and opening at the work engaging surface, a guide block fixed to the bar and slidably engaged in said guideway and an elongate vertical jack screw carried by the body for free rotation and against axial movement and extending longitudinally through said guideway and threadedly engaged through said block.

2. The machine vise set forth in claim 1 wherein the other jaw plate includes vertically adjustable steady rest means similar to the steady rest means of said one jaw plate.

3. The machine vise set forth in claim 1 wherein the body has vertically spaced axially aligned upper and lower bearing openings tapered radially inwardly and longitudinally in the same direction and opening at the upper and lower ends of the guideway, said jack has an elongate threaded shank portion extending longitudinally through the guideway, a tapered head at one end of the shank and cooperatively seated in one bearing opening and a tapered bearing at the other end of the shank and cooperatively seated in the other bearing opening, turning tool engaging means in the head and retaining means normally holding the screw with its head and bearing in predetermined pressure seated engagement in the bearing openings.

4. The machine vise set forth in claim 3 wherein the other jaw plate includes vertically adjustable steady rest means similar to the steady rest means of said one jaw plate.

5. The machine vise set forth in claim 3 wherein said head has a longitudinally outwardly disposed end surface accessible at the exterior of the body and said turning tool engaging means includes an axially outwardly opening polygonal tool receiving socket entering said end surface.

6. The machine vise set forth in claim 5 wherein the other jaw plate includes vertically adjustable steady rest means similar to the steady rest means of said one jaw plate.

7. The machine vise set forth in claim 3 wherein said retaining means includes a socket opening entering the exterior of the body concentric with the bearing opening in which the said tapered bearing is engaged, a threaded stem on the screw projecting from the tapered bearing into the socket opening, a retaining nut on the stem and within the socket opening and opposing an axially outwardly disposed bottom in the socket opening.

8. The machine vise set forth in claim 7 wherein the other jaw plate includes vertically adjustable steady rest means similar to the steady rest means of said one jaw plate.

9. The machine vise set forth in claim 7 wherein said head has a longitudinally outwardly disposed end surface accessible at the exterior of the body and said turning tool engaging means includes an axially outwardly opening polygonal tool receiving socket entering said end surface.

10. The machine vise set forth in claim 1 wherein the body has vertical rows of calibrations at laterally opposite end portions of the work engaging surface and said bar has edge portions at its opposite ends adjacent the rows of calibrations on the body.

* * * * *